US010161097B2

(12) United States Patent
Song

(10) Patent No.: US 10,161,097 B2
(45) Date of Patent: Dec. 25, 2018

(54) HYBRID FOUNDATION STRUCTURE, AND METHOD FOR BUILDING SAME

(71) Applicant: EXT Co., LTD., Seoul (KR)

(72) Inventor: Ki Yong Song, Seoul (KR)

(73) Assignee: EXT CO., LTD., Seoul (KR)

( * ) Notice: Subject to any disclaimer, the term of this patent is extended or adjusted under 35 U.S.C. 154(b) by 0 days.

(21) Appl. No.: 15/699,992

(22) Filed: Sep. 8, 2017

(65) Prior Publication Data

US 2017/0370065 A1 Dec. 28, 2017

Related U.S. Application Data

(63) Continuation-in-part of application No. 15/374,888, filed on Dec. 9, 2016, now abandoned, which is a (Continued)

(30) Foreign Application Priority Data

May 23, 2012 (KR) ..... 10-2012-0055030
May 25, 2012 (KR) ..... 10-2012-0056338
May 25, 2012 (KR) ..... 10-2012-0056345

(51) Int. Cl.

| | |
|---|---|
| ***E02D 3/12*** | (2006.01) |
| ***E02D 5/46*** | (2006.01) |
| ***E02D 5/48*** | (2006.01) |
| ***E02D 3/08*** | (2006.01) |
| ***E02D 27/16*** | (2006.01) |

(Continued)

(52) U.S. Cl.

CPC ..... *E02D 3/12* (2013.01); *E02D 3/08* (2013.01); *E02D 5/28* (2013.01); *E02D 5/30* (2013.01); *E02D 5/36* (2013.01); *E02D 5/46* (2013.01); *E02D 5/48* (2013.01); *E02D 17/02* (2013.01); *E02D 27/16* (2013.01); *E02D 27/32* (2013.01); *E02D 2250/003* (2013.01);

(Continued)

(58) Field of Classification Search

CPC .. E02D 3/12; E02D 5/46; E02D 27/12; E02D 27/32

See application file for complete search history.

(56) References Cited

U.S. PATENT DOCUMENTS 1,157,442 A * 10/1915 Stewart ..... E02D 5/385 405/240
3,638,433 A * 2/1972 Sherard ..... E02D 1/04 405/50

(Continued)

FOREIGN PATENT DOCUMENTS

GB 1103522 A * 2/1968 ..... E02D 5/18
JP 2000-017652 A 1/2000

(Continued)

OTHER PUBLICATIONS

International Search Report for PCT/KR2013/004414 filed on May 21, 2013.

*Primary Examiner* — Frederick L Lagman

(57) ABSTRACT

A hybrid foundation structure includes a first perforation hole formed in the ground, at least one second perforation hole formed adjacent to the first perforation hole on a side surface of the first perforation hole, and a first pile and a second pile formed by mixing and injecting soil and soil solidifying agent into the first perforation hole and the second perforation hole.

7 Claims, 23 Drawing Sheets

Related U.S. Application Data continuation of application No. 14/403,150, filed as application No. PCT/KR2013/004414 on May 21, 2013, now Pat. No. 9,546,465.

(51) Int. Cl.

| | |
|---|---|
| ***E02D 17/02*** | (2006.01) |
| ***E02D 27/32*** | (2006.01) |
| ***E02D 5/28*** | (2006.01) |
| ***E02D 5/30*** | (2006.01) |
| ***E02D 5/36*** | (2006.01) |

(52) U.S. Cl.

CPC ..... *E02D 2250/0023* (2013.01); *E02D 2300/002* (2013.01); *E02D 2300/0029* (2013.01)

(56) References Cited

U.S. PATENT DOCUMENTS 3,969,902 A * 7/1976 Ichise ..... E02D 5/12 405/266
4,065,928 A * 1/1978 Takagi ..... E02D 5/18 405/267
4,065,933 A * 1/1978 Katayama ..... E02D 5/18 405/223
4,662,792 A * 5/1987 Gessay ..... E02D 5/18 405/233
4,906,142 A * 3/1990 Taki ..... E02D 3/126 405/233
5,013,185 A * 5/1991 Taki ..... E02D 3/126 405/128.45
5,026,216 A * 6/1991 Koiwa ..... E02D 3/12 405/233
5,118,223 A * 6/1992 Taki ..... E02D 5/18 405/129.8
5,219,247 A * 6/1993 Gemmi ..... E02D 5/46 405/237
5,378,085 A * 1/1995 Kono ..... E02D 3/126 405/233
5,417,522 A * 5/1995 Kono ..... E02D 3/12 405/236
5,738,465 A * 4/1998 Gessay ..... E02D 3/126 299/57
5,779,397 A * 7/1998 Takemiya ..... E02D 3/12 404/31
6,183,166 B1 * 2/2001 Schellhorn ..... E02D 5/38 405/233
7,413,385 B2 * 8/2008 Moroschan ..... E02D 3/08 405/229
9,546,465 B2 * 1/2017 Song ..... E02D 3/08
2007/0189859 A1 * 8/2007 Gunther ..... E02D 3/126 405/233

FOREIGN PATENT DOCUMENTS

| | | |
|---|---|---|
| JP | 2008-156837 A | 7/2008 |
| KR | 10-0795850 B1 | 1/2008 |
| KR | 10-1029508 B1 | 4/2011 |

* cited by examiner

[Fig. 1]
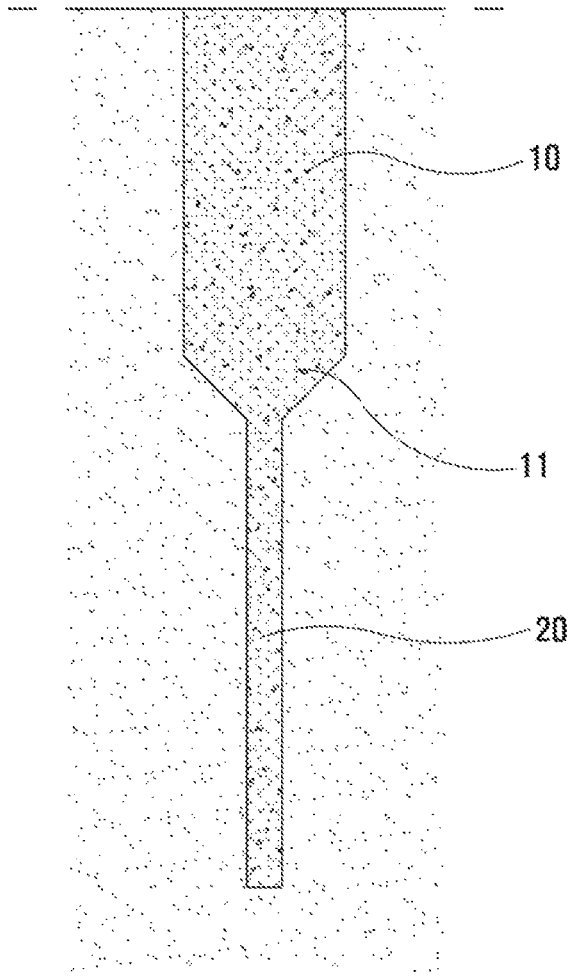

[Fig. 2a]
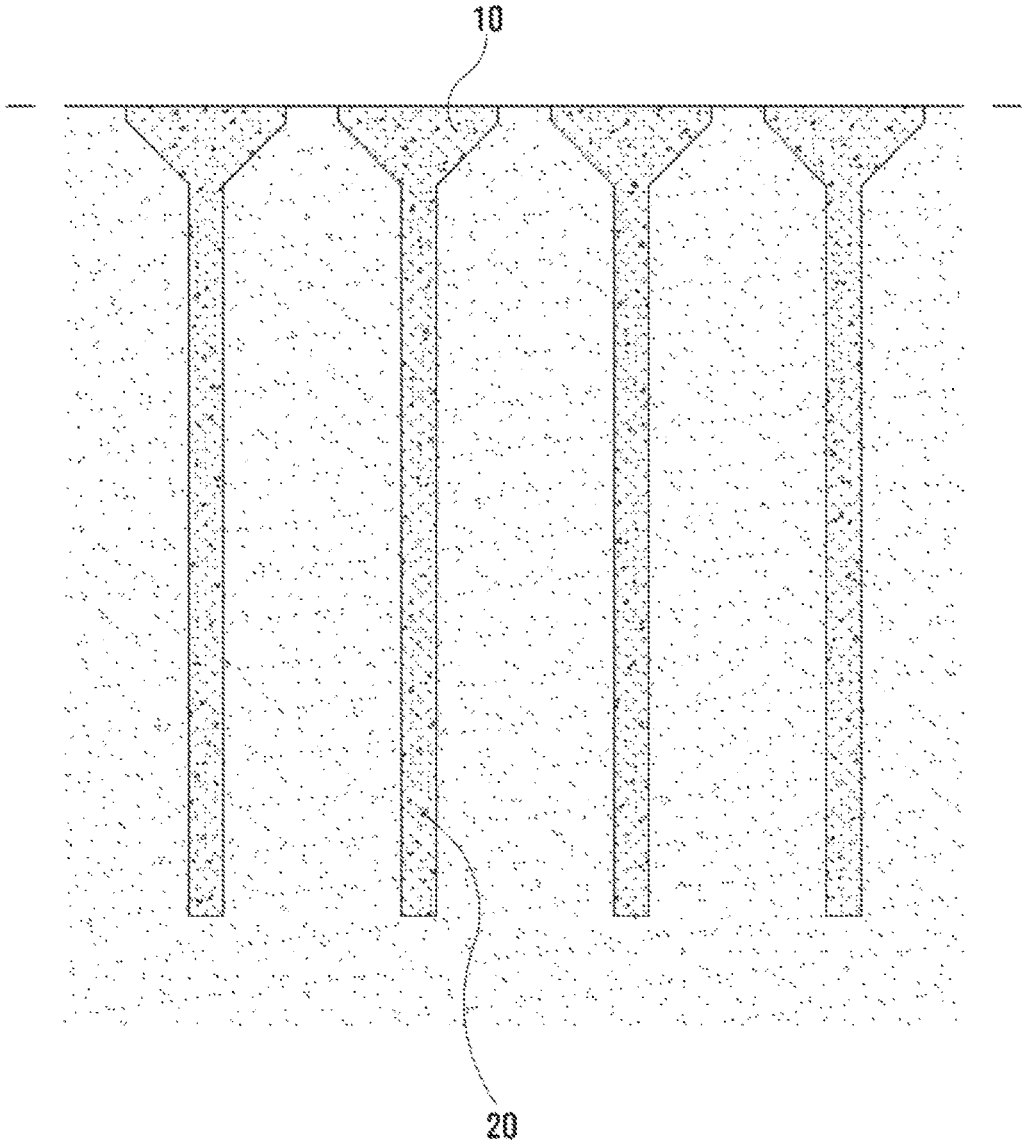

[Fig. 2b]
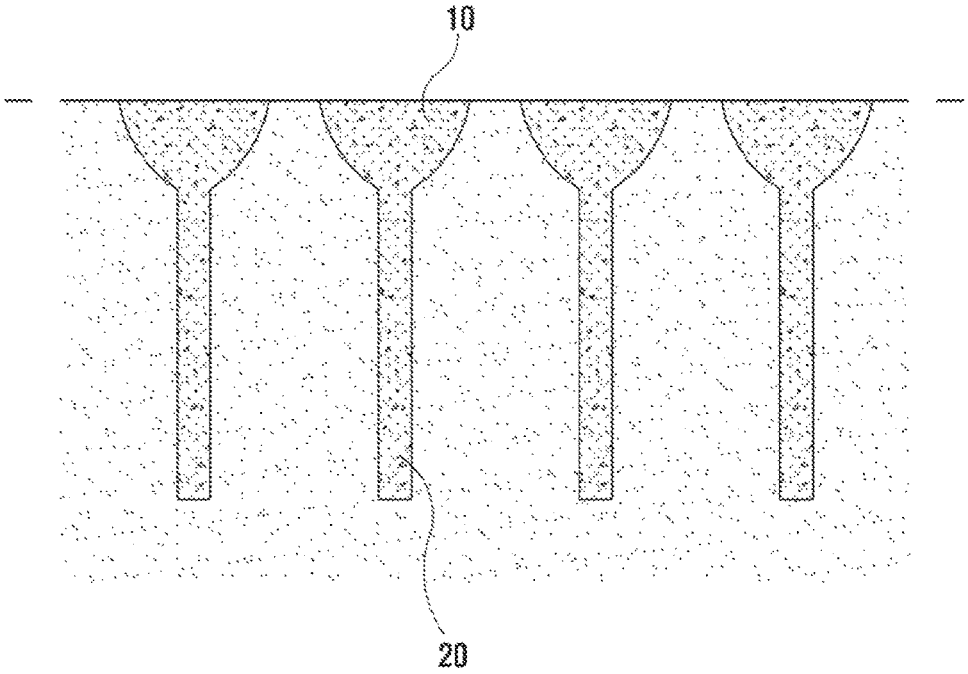
[Fig. 3]
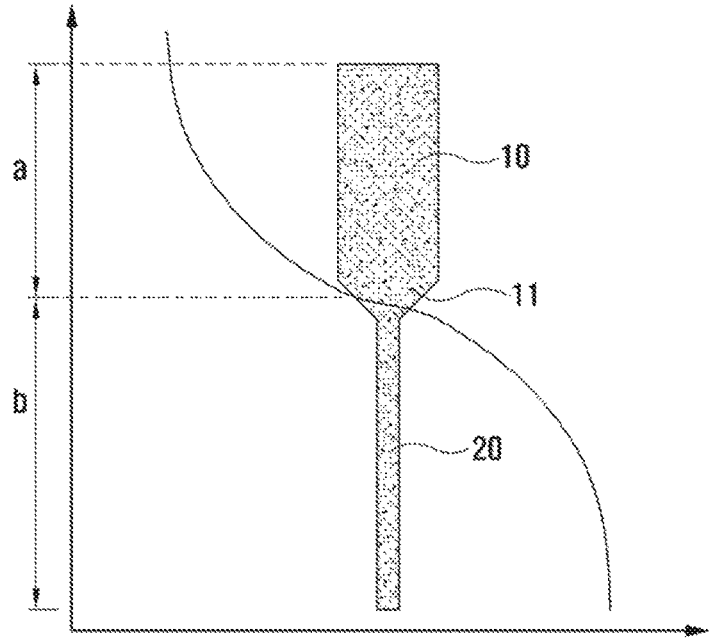

[Fig. 4]
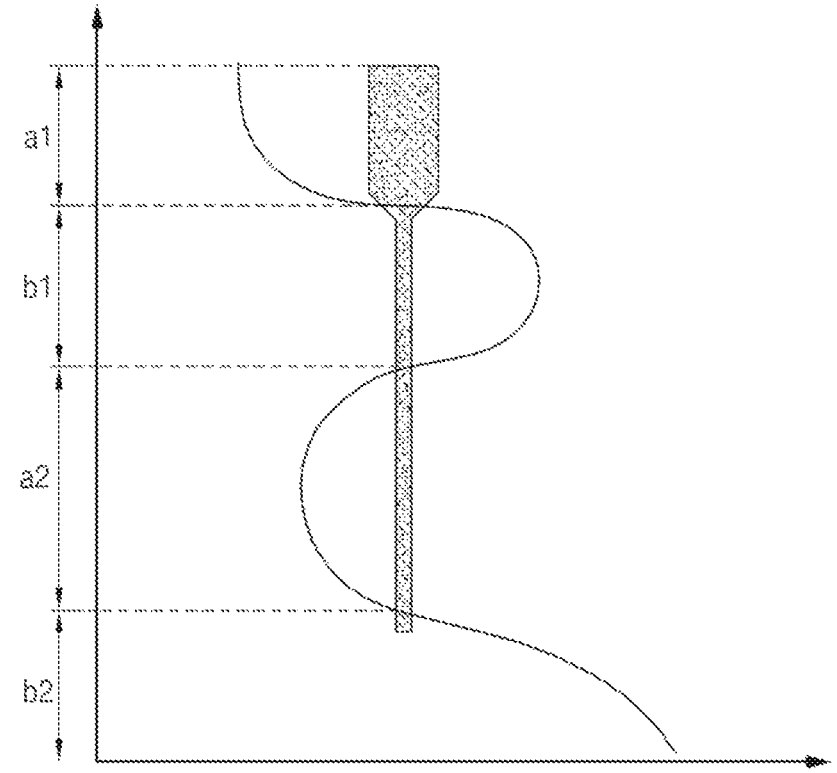

[Fig. 5]
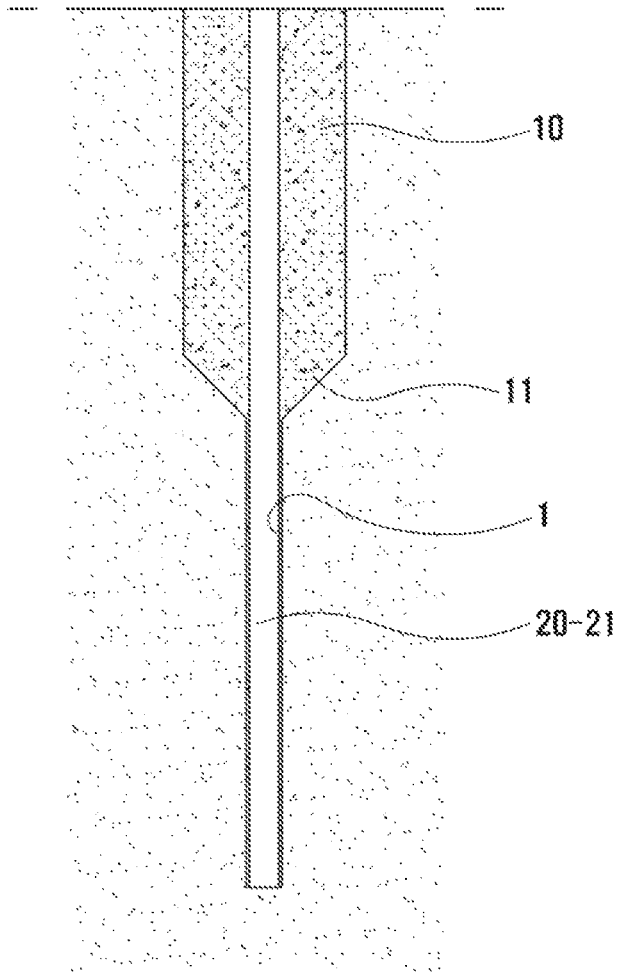

[Fig. 6]
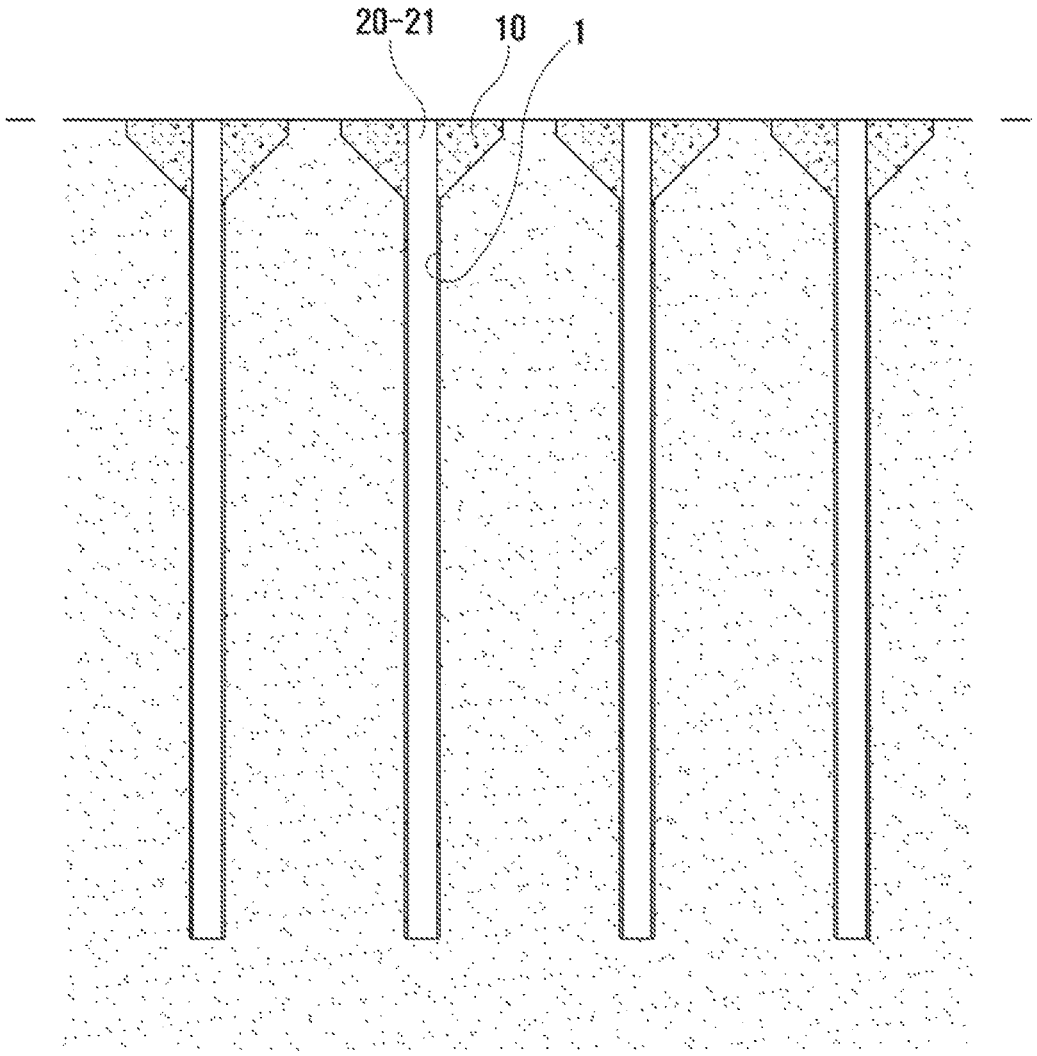

[Fig. 7]
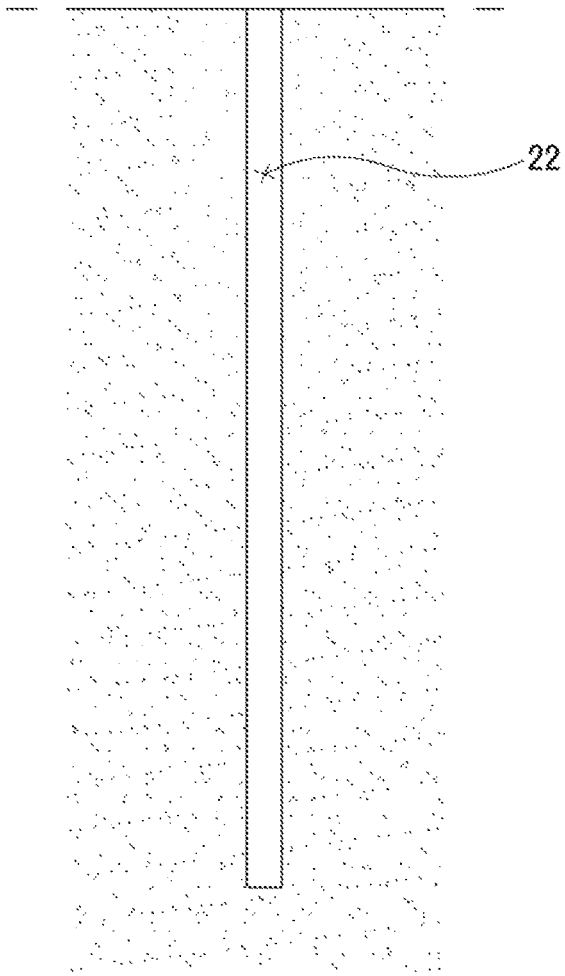

[Fig. 8]
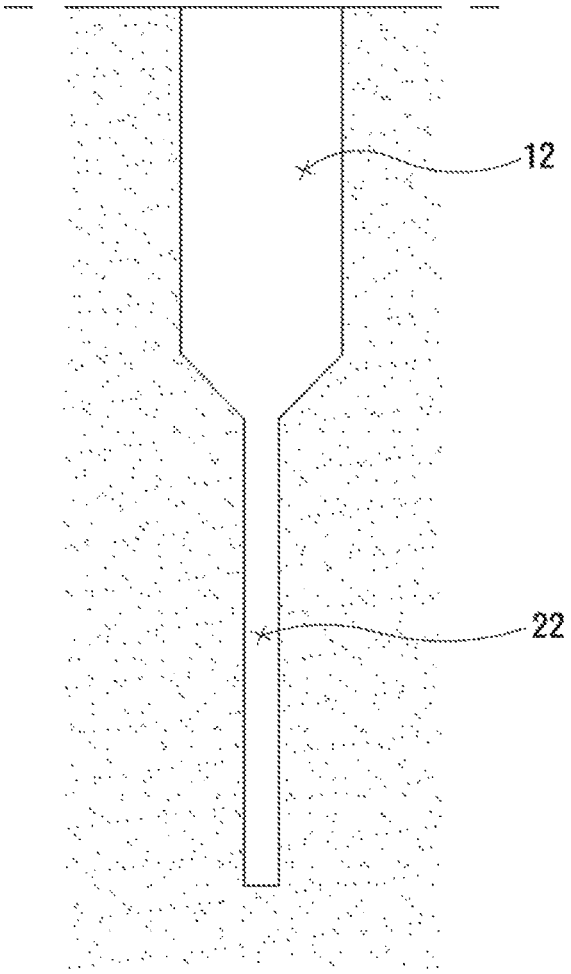

[Fig. 9]
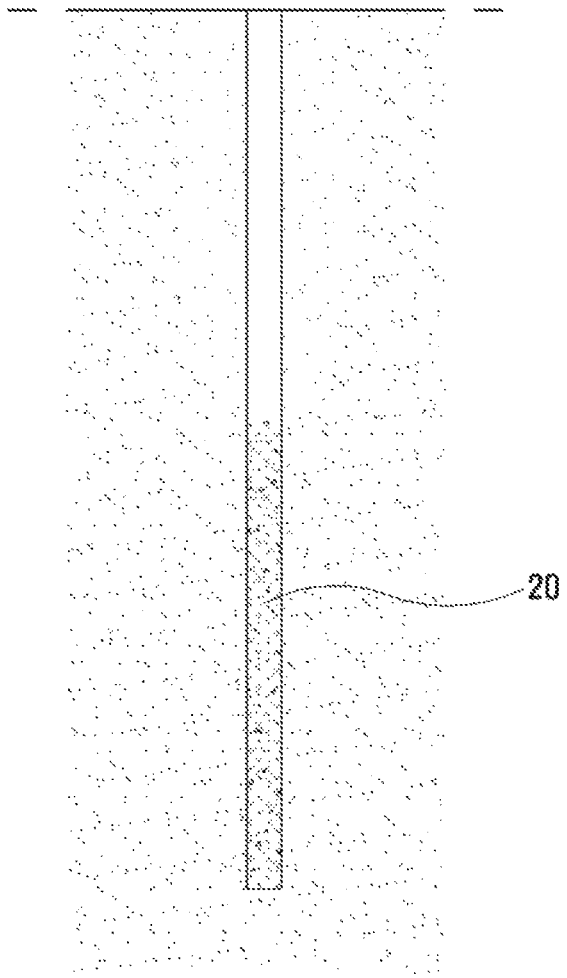

[Fig. 10]
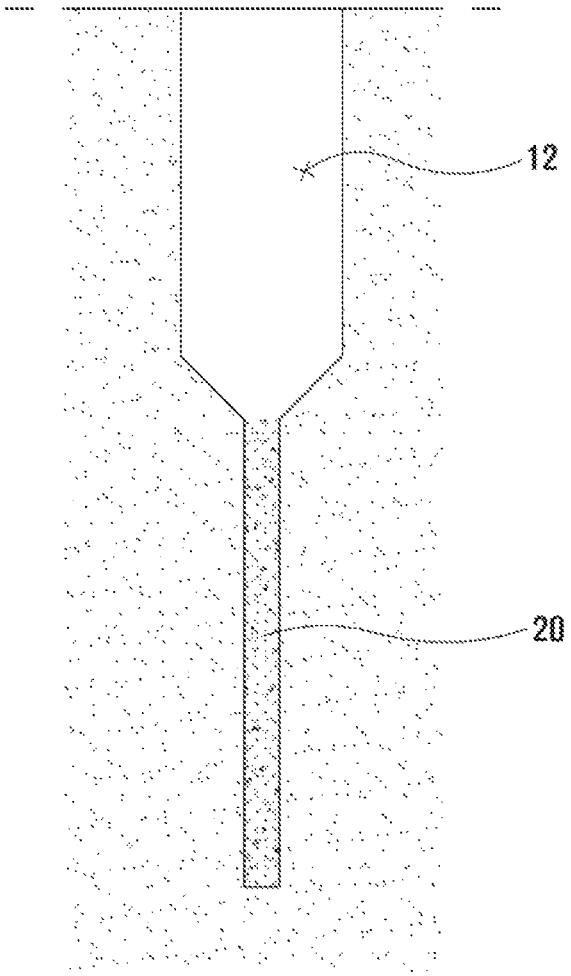

[Fig. 11]
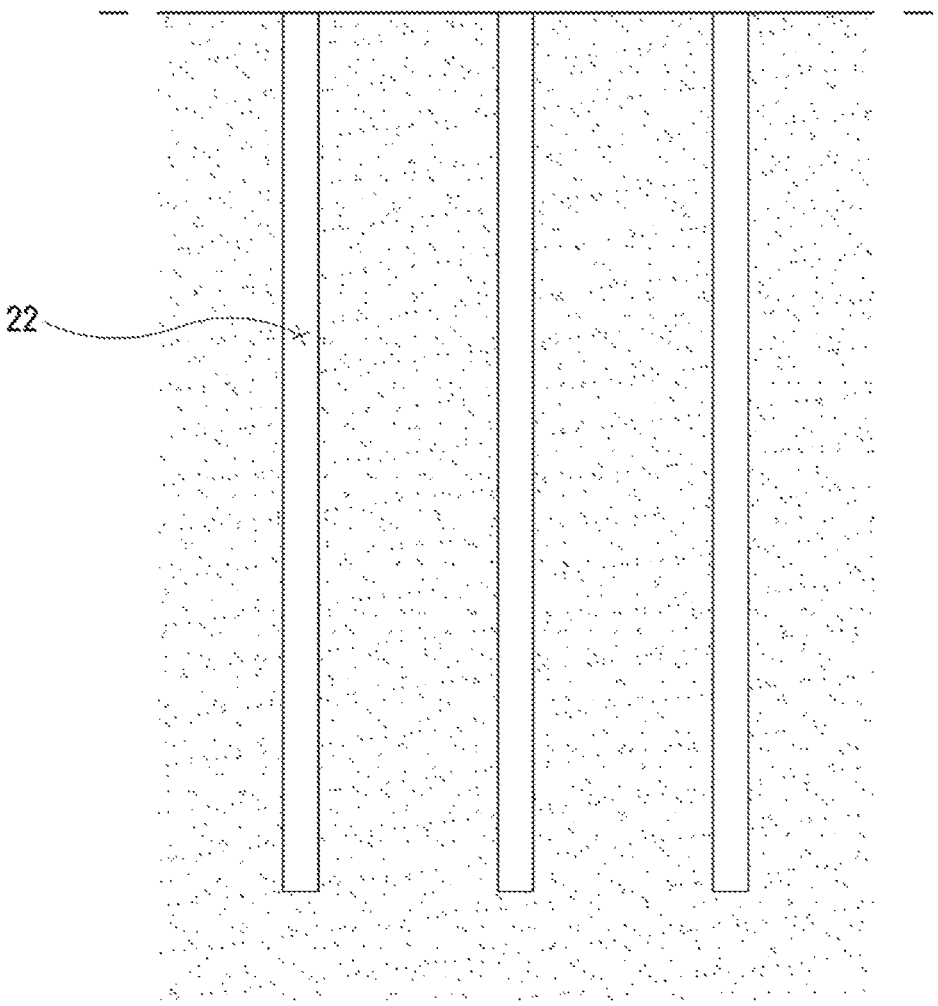

[Fig. 12]
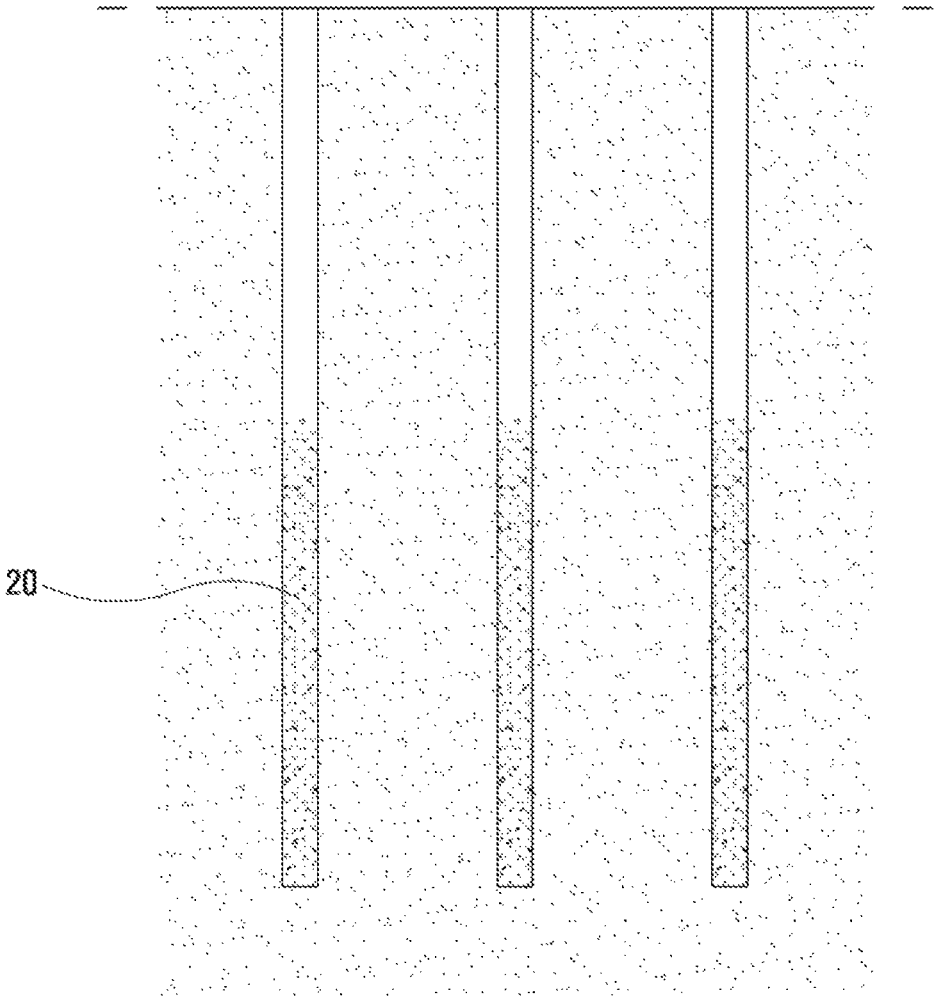

[Fig. 13]
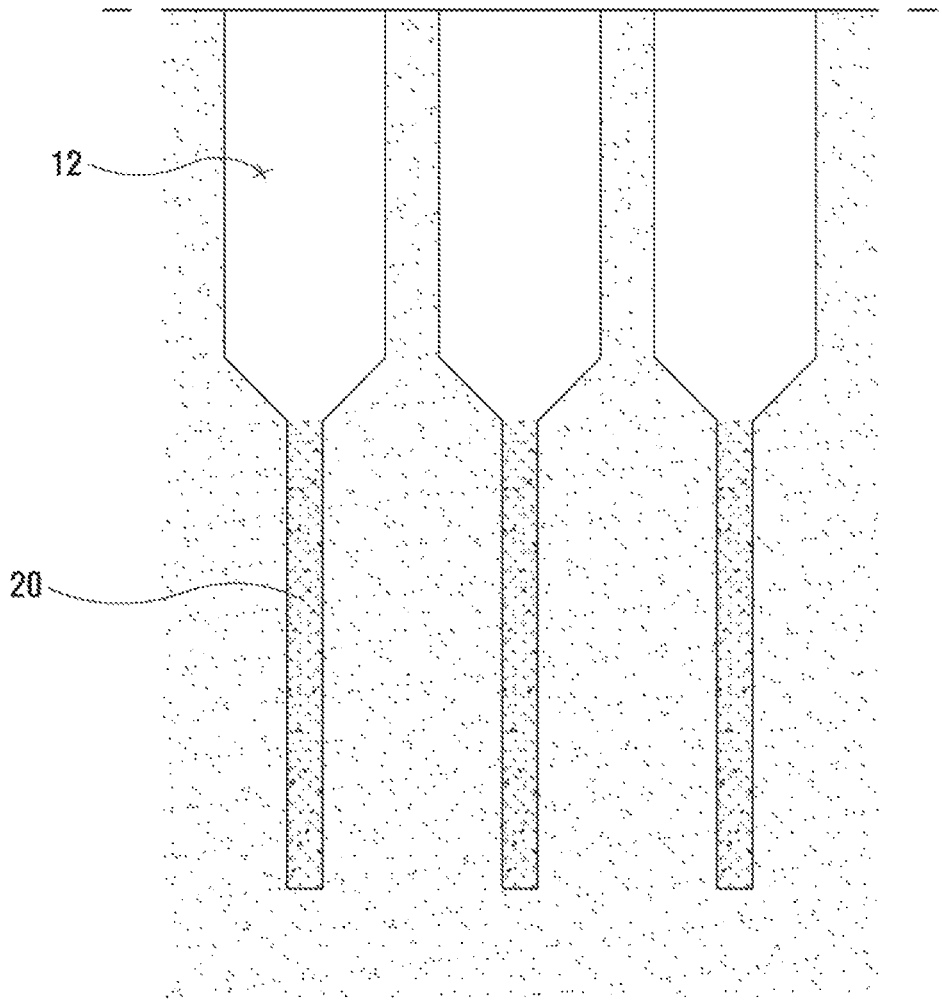

[Fig. 14]
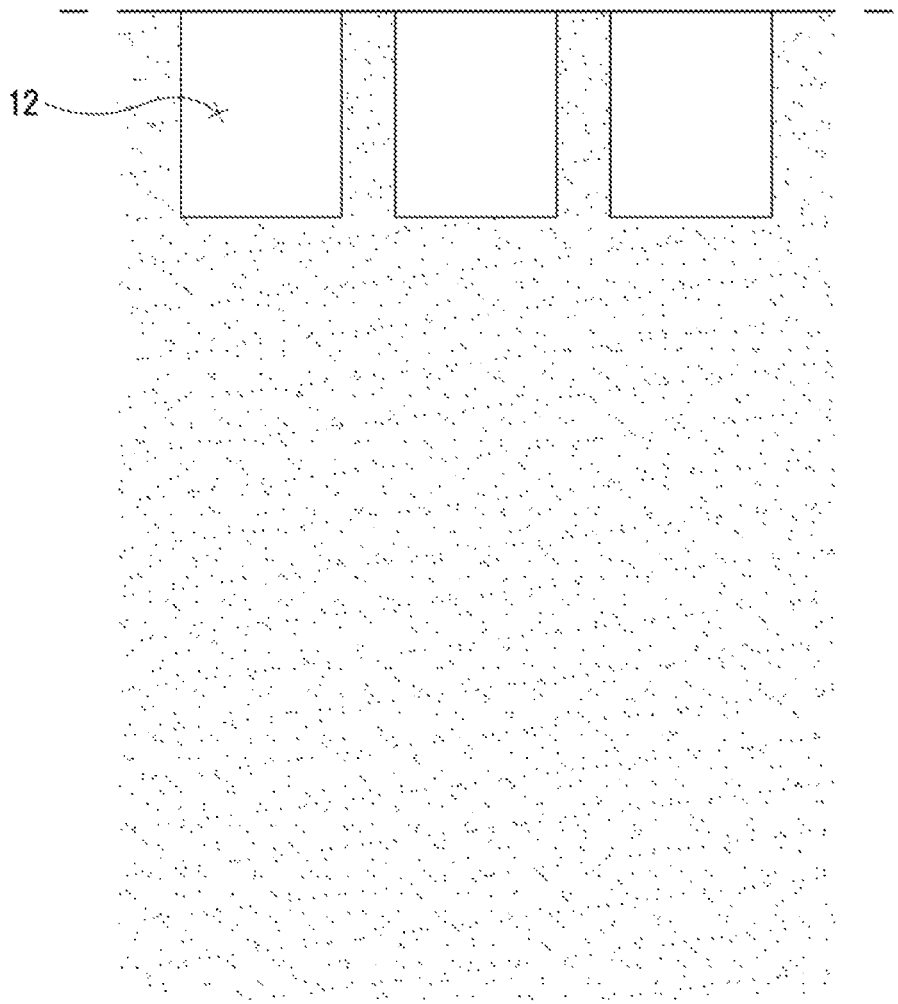

[Fig. 15]
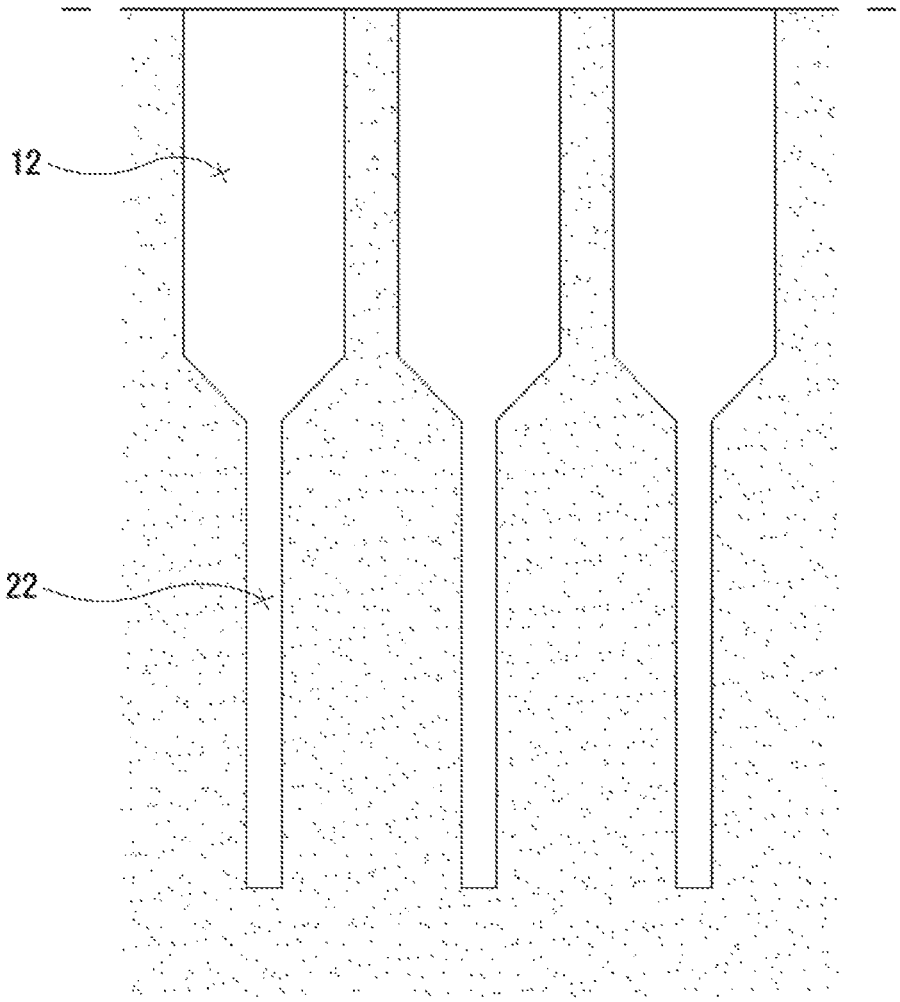

[Fig. 16]
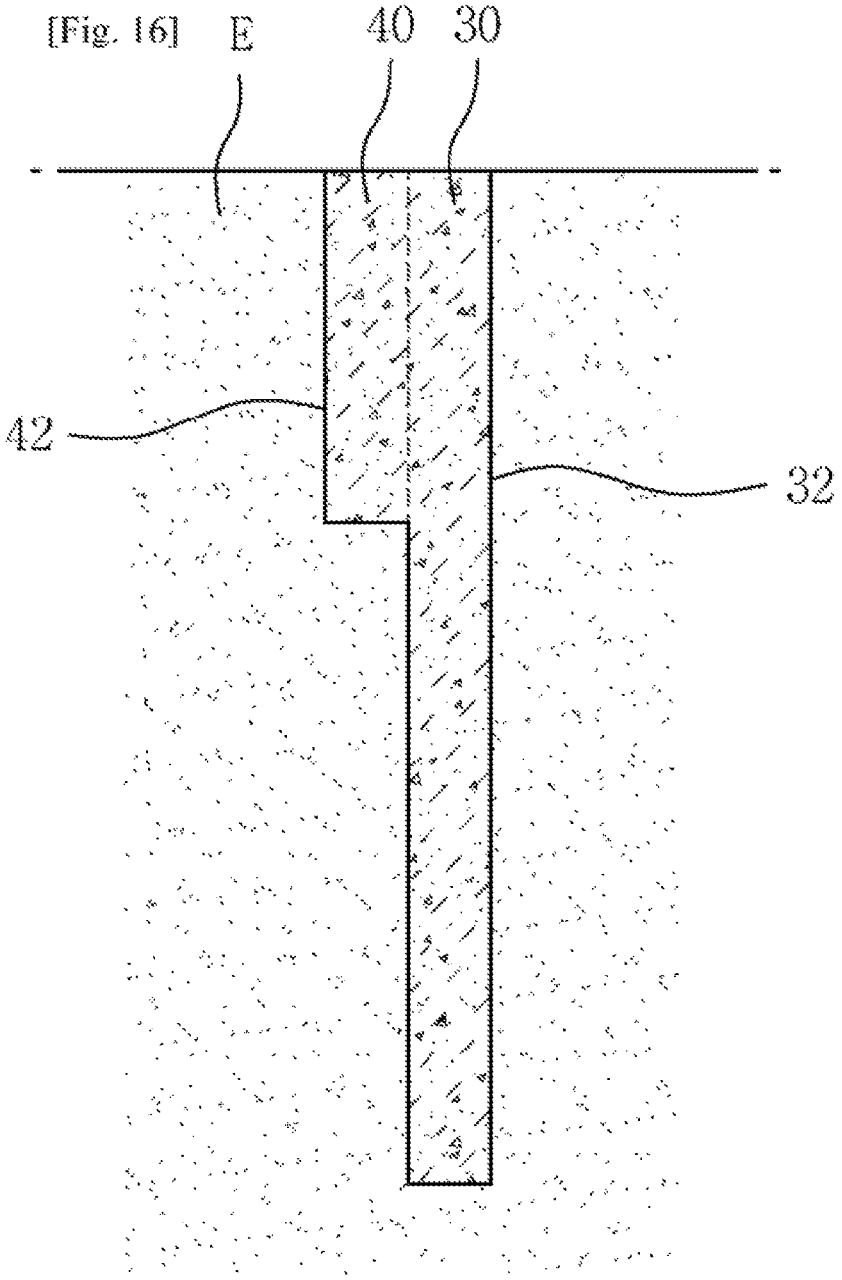

[Fig. 17]
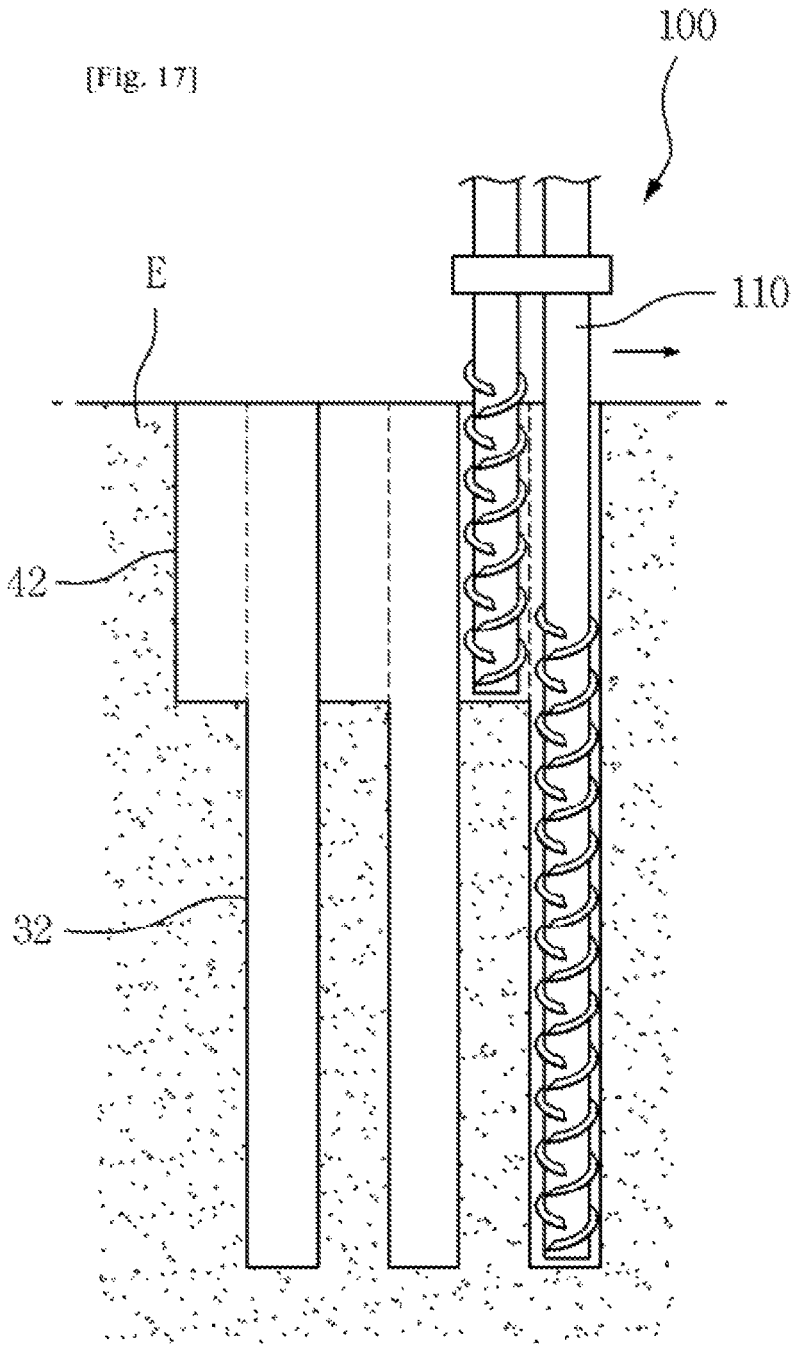

[Fig. 18]
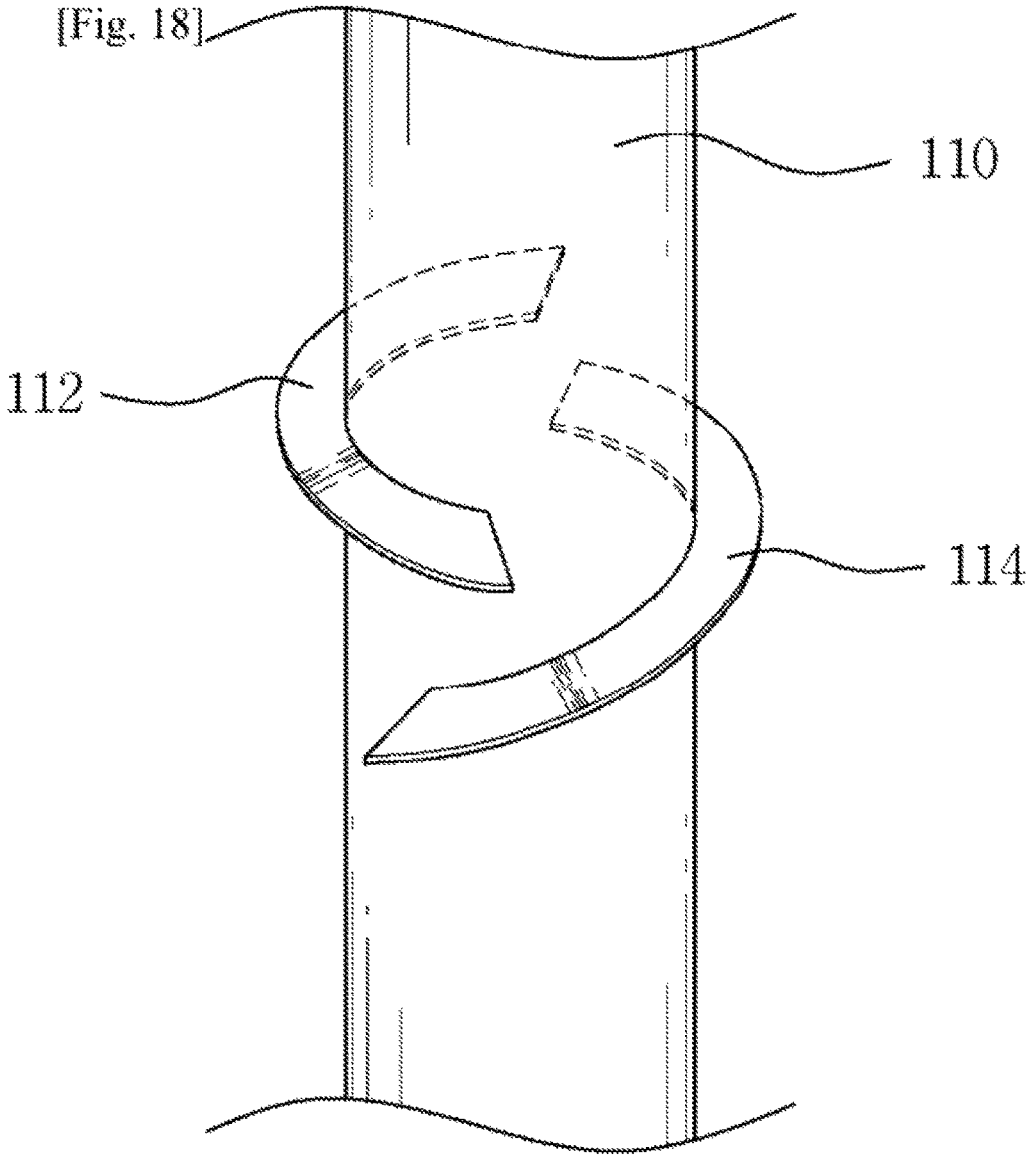

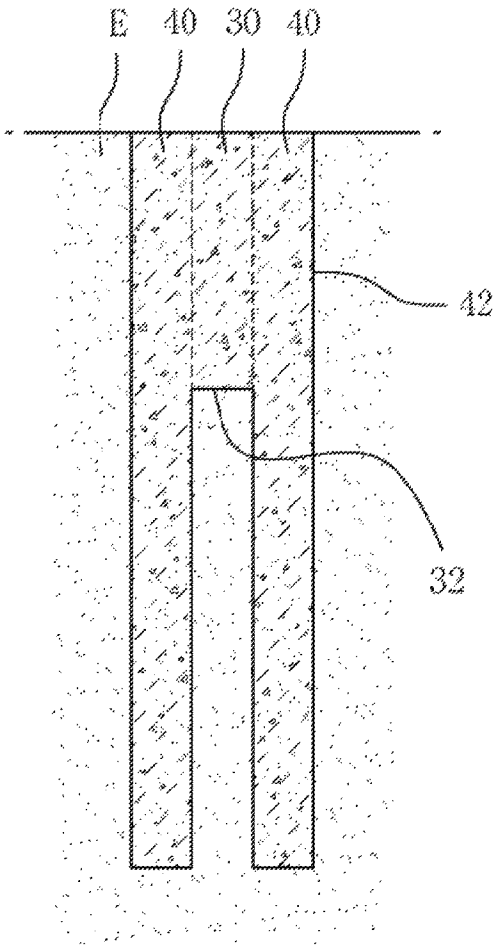
[Fig. 19b]
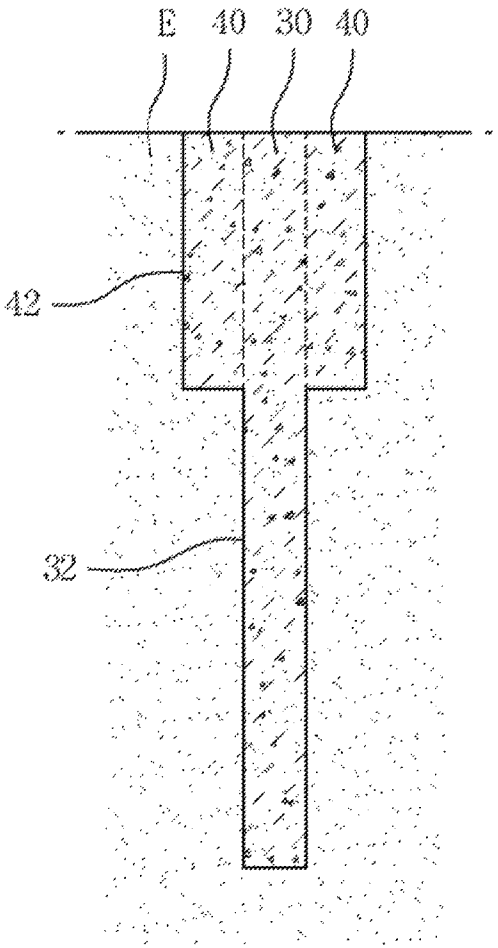
[Fig. 19a]

[Fig. 20]
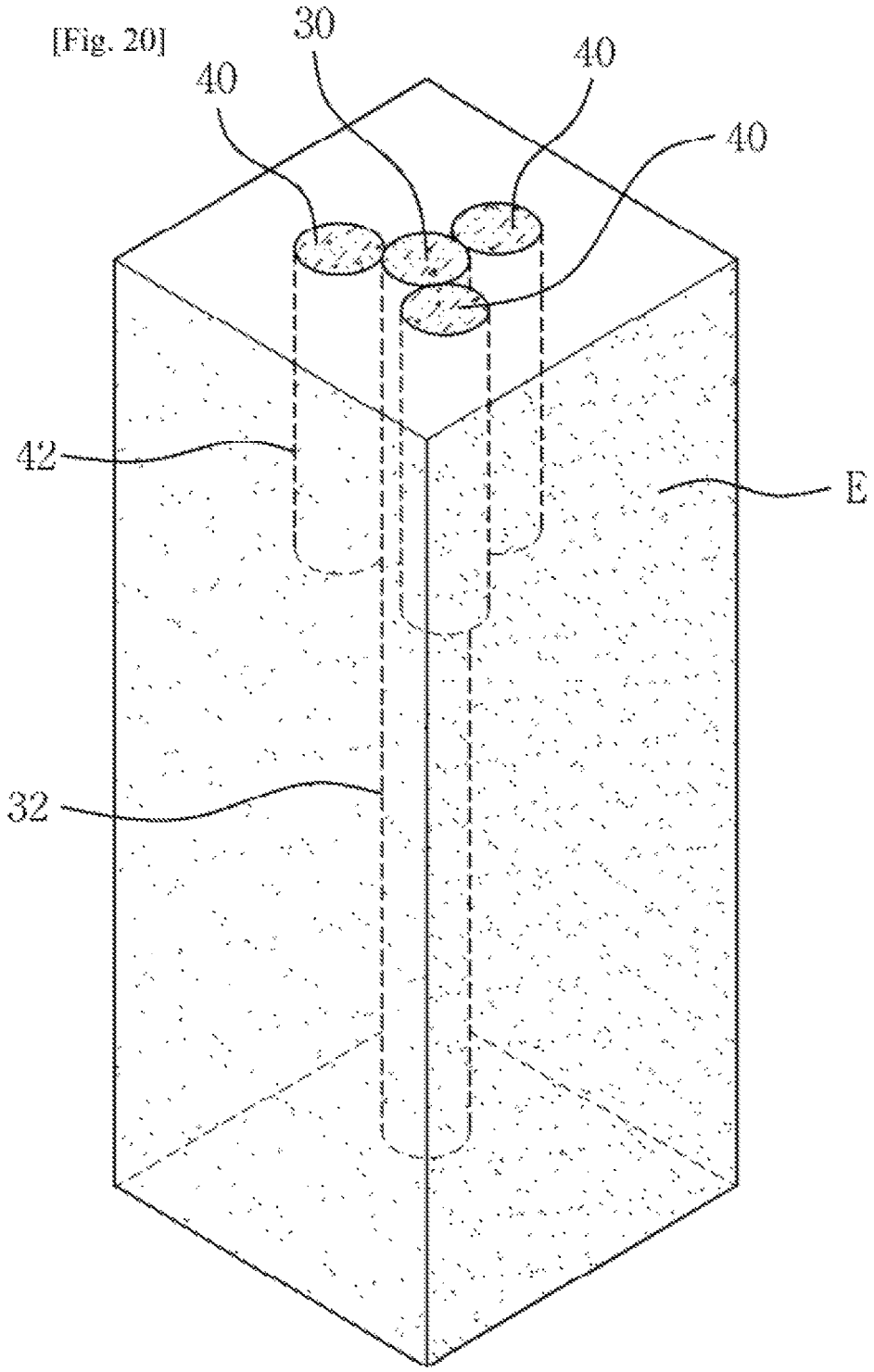

[Fig. 21]
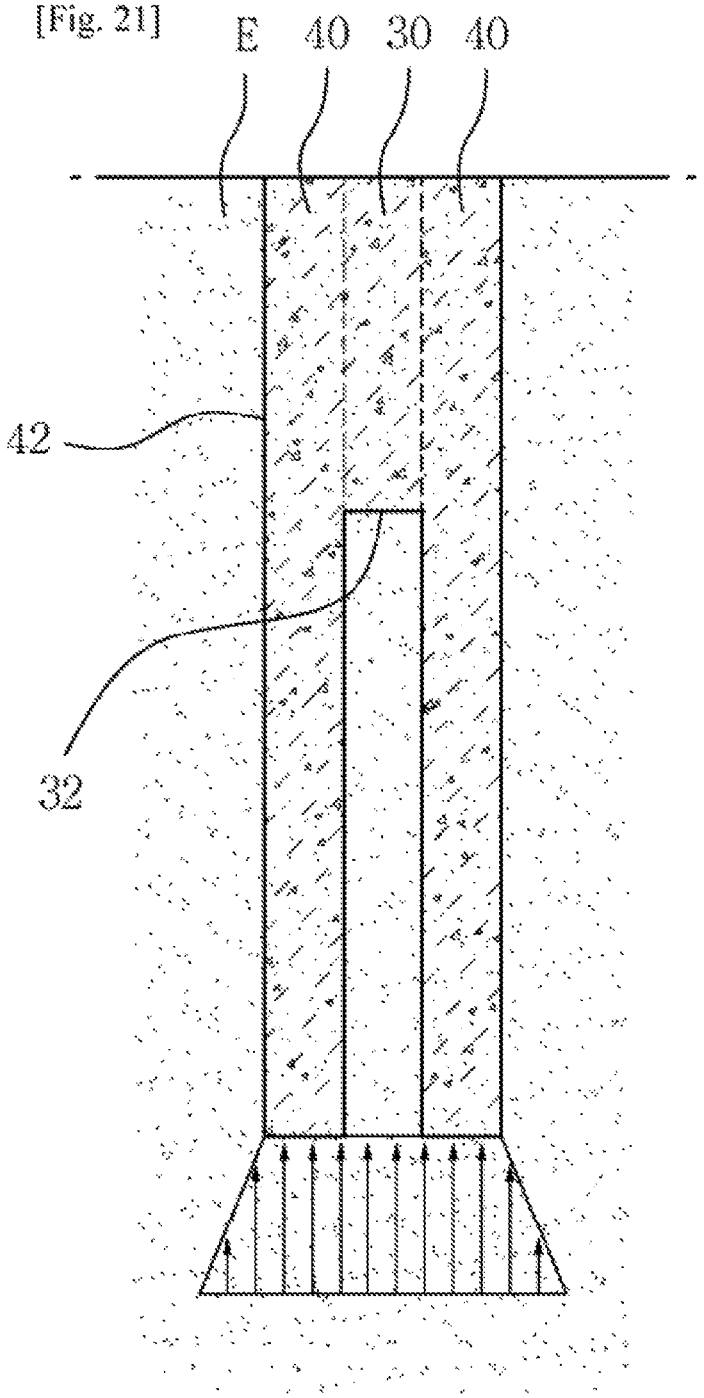

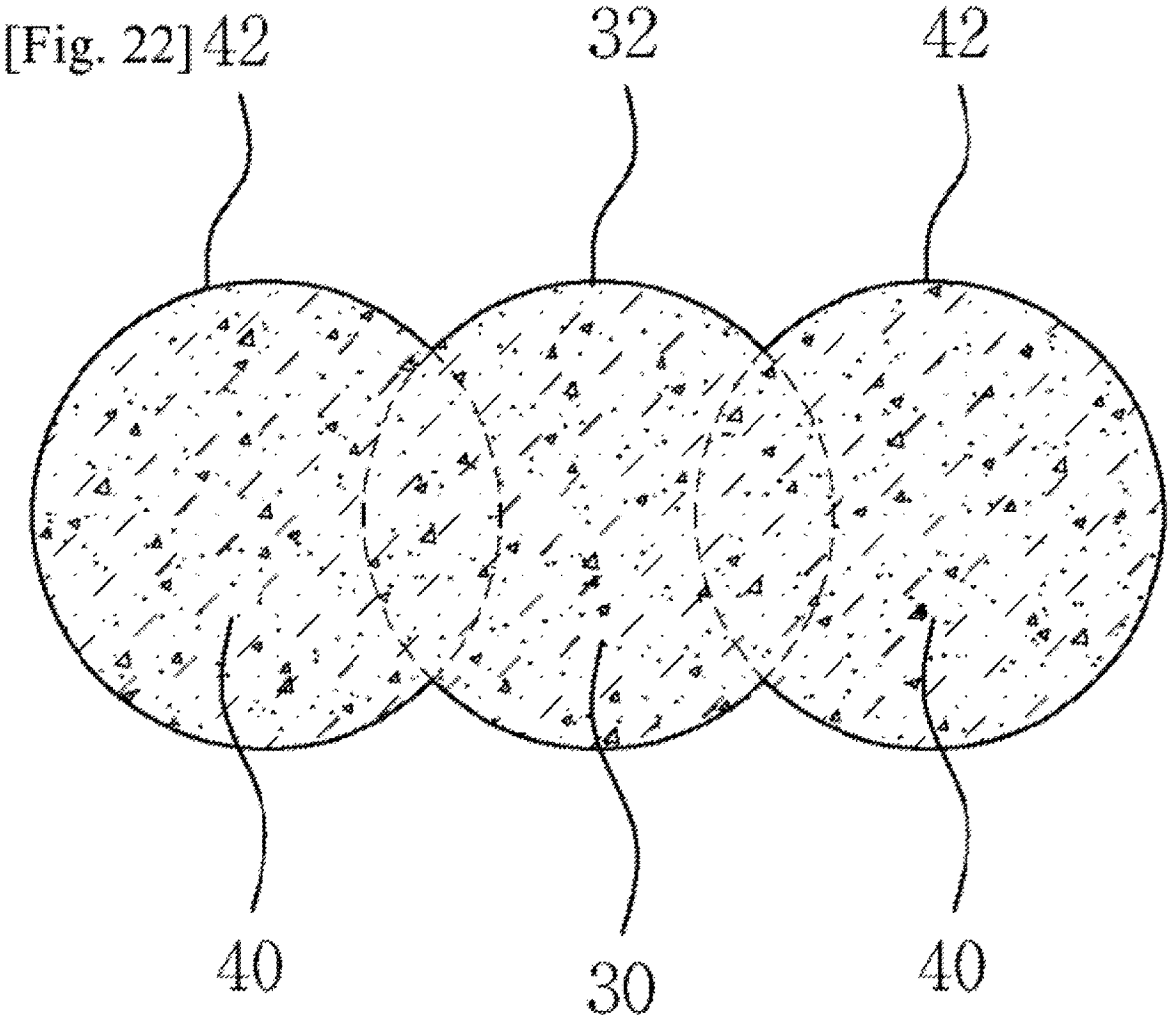
[Fig. 22]

[Fig. 23]
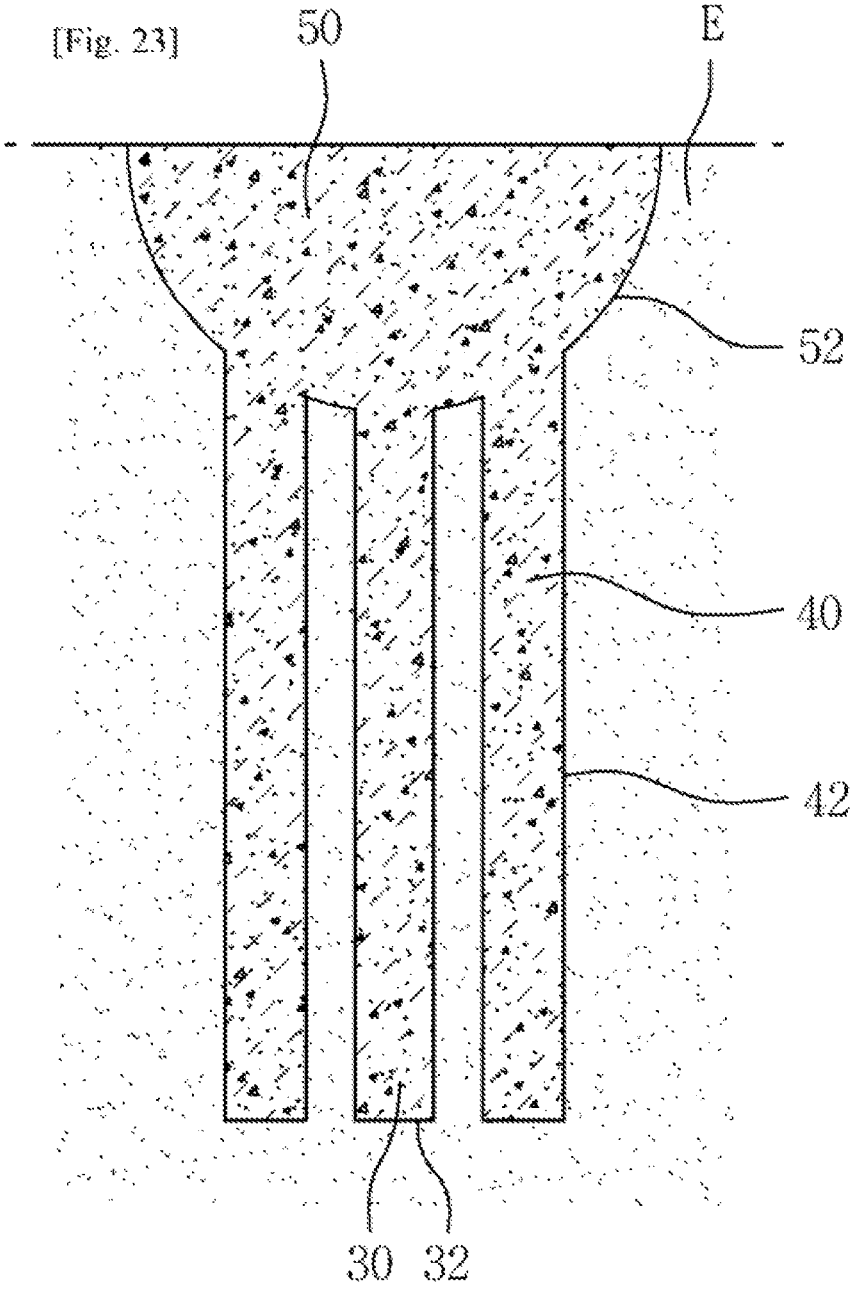

HYBRID FOUNDATION STRUCTURE, AND METHOD FOR BUILDING SAME

CROSS-REFERENCE TO RELATED APPLICATIONS

The present specification is a continuation-in-part of U.S. patent application Ser. No. 15/374,888 filed on Dec. 9, 2016, which is a continuation of U.S. patent application Ser. No. 14/403,150 filed on Nov. 21, 2014, now issued as U.S. Pat. No. 9,546,465, which is a U.S. National Stage of International Patent Application No. PCT/KR2013/004414 filed May 21, 2013, which claims priority to and the benefit of Korean Patent Application Nos. 10-2012-0056345, 10-2012-0056338, and 10-2012-0055030, filed in the Korean Intellectual Property Office on May 25, 2012, May 25, 2012, and May 23, 2012, respectively, the entire contents of which are incorporated herein by reference.

TECHNICAL FIELD

The present invention relates to the civil engineering field, more particularly, a foundation structure.

BACKGROUND ART

In order to ensure the ground's bearing capacity of soil for constructing a structure, linear piles including steel piles, PHC piles, etc. are generally constructed.

However, these conventional piles have the following problems.

First, the ground is not formed to have a generally constant bearing capacity of soil and there exist layers (supporting layers such as a weak stratum, a rock layer, and so on) having different bearing capacities of soil from each other according to their depths. Despite this, conventional piles have all the same cross sections regardless of the depth, and therefore are not efficient.

Second, because a boring hole should be formed with the same diameter even in the deep depth, boring equipment is overloaded.

DISCLOSURE

Technical Problem

The present invention is devised to solve problems described above and directed to providing a hybrid foundation structure and the method thereof, which is efficient in reinforcing the soft ground as well as preventing the subsidence of the ground, and keeps boring equipment from the overload.

Technical Solution

In order to solve the problems hereinbefore, the present invention relates to a foundation structure vertically installed on the ground, and comprising: an upper support layer 10 formed on the ground in the vertical direction; a lower support layer 20 extended downward from the upper support layer 10 in order to have the narrower width compared to the width of the upper support layer 10. And the upper support layer 10 and the lower support layer 20 provide a hybrid foundation structure formed from solidified soil which is the mixture of earth, sand, and a soil-solidifying agent.

It is preferable that the lower support layer 20 is formed with deeper depth compared to the depth of the upper support layer 10.

It is preferable that the upper support layer 10 is formed with narrower width of the lower part compared to the width of the upper part.

It is preferable that the upper support layer 10 is formed into a conical structure, and the lower support layer 20 is formed in the lower part of the upper support layer 10 and extended downward therefrom.

It is preferable that the upper support layer 10 and the lower support layer 20 are formed into a cylindrical structure, and a variable cross-section support layer 11 with a tapering variable cross-sectional structure is formed in the lower part of the upper support layer 10.

When the ground is formed downward in the order of a weak stratum and a support layer b, it is preferable that the boundary part of the upper support layer 10 and the lower support layer 20 is formed to place in either the lower part of the weak stratum a or the upper part of the support layer b; the lower support layer 20 is formed to place in the support layer b.

When the ground is formed downward in the order of a first weak stratum a1, a first support layer b1, a second weak stratum a2, and a second support layer b2, it is preferable that the boundary part of the upper support layer 10 and the lower support layer 20 is formed to place in either the lower part of the first weak stratum a1 or the upper part of the first support layer b1; the lower part of the lower support layer 20 is formed to place in either the lower part of the second weak stratum a2 or the upper part of the second support layer b2.

It is preferable to insert a steel or concrete material core 21 into the lower support layer 20.

It is preferable for the core 21 to be laid under the ground with its upper part penetrating through the center of the upper support layer 10.

The present invention relates to a method for the construction of the hybrid foundation structure, wherein a boring hole is formed on the ground and the mixture of earth, sand, and a soil-solidifying agent is injected into the boring hole 1 for forming the upper support layer 10 and the lower support layer 20.

The present invention relates to a method for the construction of the hybrid foundation structure and in order to form the upper support layer 10 and the lower support layer 20, it includes: a boring step to form a boring hole 1 on the ground; a basic formation step to inject the mixture of earth, sand, and a soil-solidifying agent into the boring hole 1 for forming the upper support layer 10 and the lower support layer 20.

It is preferable that the boring step and the basic formation step include: a step to form a small boring hole 22 for forming the lower support layer 20; a step to extend the upper part of the small boring hole 22 to form a large boring hole 12 for forming the upper support layer 10; a step to inject the mixture of earth, sand, and a soil-solidifying agent into the small boring hole 22 and the large boring hole 12 for forming the upper support layer 10.

It is preferable that the boring step and the basic formation step include: a step to form a small boring hole 22 for forming the lower support layer 20; a step to inject the mixture of earth, sand, and a soil-solidifying agent into the small boring hole 22 for forming the lower support layer 20; a step to extend the upper part of the small boring hole 22 to form a large boring hole 12 for forming the upper support layer 10; a step to inject the mixture of earth, sand, and a soil-solidifying agent into the large boring hole 12 for forming the upper support layer 10.

It is preferable that the boring step and the basic formation step include: a step to form a plural small boring holes 22 for forming the plural lower support layers 20; a step to inject the mixture of earth, sand, and a soil-solidifying agent into the plural small boring holes 22 for forming the plural lower support layers 20; a step to extend the upper part of the plural small boring holes 22 to form the large boring holes 12 for forming the plural upper support layers 10; a step to inject the mixture of earth, sand, and a soil-solidifying agent into the plural large boring holes 12 for forming the plural upper support layers 10.

It is preferable that the boring step and the basic formation step include: a step to form a plural large boring holes 12 for forming the plural upper support layers 10; a step to excavate the lower part of the plural large boring holes 12 to form the plural small boring holes 22 for forming the plural lower support layers 20; a step to inject the mixture of earth, sand, and a soil-solidifying agent into the plural large boring holes 12 and the plural small boring holes 22 for forming the plural upper support layers 10 and the plural lower support layers 20.

The present invention relates to a method for the construction of the hybrid foundation structure and in order to form the upper support layer 10 and the lower support layer 20, it includes: a boring step to form a boring hole 1 on the ground; a step to penetrate the core 21 into the boring hole 1 for forming the lower support layer 20; a step to inject the mixture of earth, sand, and a soil-solidifying agent into the boring hole 1.

The earth and sand are preferably slimes produced in the boring step.

The earth and sand are preferably the mixture of slimes produced in the boring step and aggregates.

In the boring step and the basic formation step, it is preferable to ridge a part of slimes produced in the boring step, and inject the mixture of remaining slimes, the aggregates and the soil-solidifying agent.

Advantageous Effects

A foundation structure according to the present invention may implement high bearing capacity by securing various different support layers depending on the depth of the ground, and accordingly it is effective for the reinforcement of the ground or suppressing subsidence of the ground.

In addition, using solidified soil results the fast solidification effect even in the soil with high water content, and utilizing the field generated soil is cost-effective.

Further, a boring hole is formed with a relatively small diameter in the deep depth, which may reduce the amount of material necessary to form a foundation structure and efficiently prevent the overload of boring equipment.

According to another embodiment of the present invention, a plurality of peripheral piles can be arranged around the central pile, instead of forming a concentric large-sized pile having the same center as that of the conventional small pile. Thus, the layout and depth of the piles as well as the shape can be configured in various ways.

According to another embodiment t of the present invention, it is possible to easily form the first and second pile sections, thereby providing excellent workability, shortening the time required for forming the perforation holes, since a plurality of perforation holes can be formed at the same time by using the multi-axis auger.

DESCRIPTION OF DRAWINGS

FIG. 1 to FIG. 7 are exemplary embodiments of a foundation structure according to the present invention.

FIG. 1 is a cross-sectional view of the first embodiment.

FIG. 2*a* is a cross-sectional view of the second embodiment.

FIG. 2*b* is a cross-sectional view of the third embodiment.

FIG. 3 is a cross-sectional view of the fourth embodiment.

FIG. 4 is a cross-sectional view of the fifth embodiment.

FIG. 5 is a cross-sectional view of the sixth embodiment.

FIG. 6 is a cross-sectional view of the seventh embodiment.

FIG. 7 and the rest illustrate exemplary embodiments of a method for constructing a structure according to the present invention.

FIG. 7, 8 are process drawings of the first exemplary embodiment.

FIG. 9, 10 are process drawings of the second exemplary embodiment.

FIG. 11 to 13 are process drawings of the third exemplary embodiment.

FIG. 14, 15 are process drawings of the fourth exemplary embodiment.

FIG. 16 is a sectional view of a hybrid foundation structure according to another embodiment of the present invention.

FIG. 17 is a construction example of the hybrid foundation structure according to another embodiment of the present invention.

FIG. 18 is an enlarged view of a perforation shaft used for perforating the hybrid foundation structure according to another embodiment of the present invention.

FIG. 19*a*, 19*b* are sectional views of the hybrid foundation in which a first pile has second piles on both sides.

FIG. 20 is a perspective view of the hybrid foundation structure in which second piles are formed radially on the outer periphery of the first pile.

FIG. 21. is a sectional view of the hybrid foundation structure in which the length of first pile is shorter than the length of second piles.

FIG. 22 is a cross-sectional view of the hybrid foundation structure in which the first pile and the second pile are partially overlapped.

FIG. 23 is a sectional view of the hybrid foundation structure in which a large pile is formed on the top.

DETAILED DESCRIPTION OF MAIN ELEMENTS

1: boring hole
10: upper support layer
11: variable cross-section support layer
12: large boring hole
20: lower support layer
21: core
22: small boring hole
a, a1, a2: weak stratum
b, b1, b2: support layer
30: first pile
32: first perforation hole
40: second pile
42: second perforation hole
50: large pile
52: enlarged perforation hole

BEST MODE

Hereunder is given a more detailed description of exemplary embodiments according to the present invention using appended drawings.

As illustrated in FIG. 1 and the rest, the present invention relates to a foundation structure vertically installed on the ground, and comprising: an upper support layer 10 formed on the ground in the vertical direction; a lower support layer 20 extended downward from the upper support layer 10 in order to have the narrower width compared to the width of the upper support layer 10.

And the upper support layer 10 and the lower support layer 20 are formed by the injection of solidified soil which is the mixture of earth, sand, and a soil-solidifying agent.

That is, the present disclosure relates to a hybrid foundation structure, wherein the upper support layer 10 and the lower support layer 20 with different cross-sectional sizes from each other and vertically positioned, are formed in an overall variable cross-sectional structure which allows customized conditions to be applied considering the situation of the ground and site unlike the conventional foundation structure formed in overall the same cross-sectional structure.

Further, the upper support layer 10 and the lower support layer 20 are formed by the injection of solidified soil which is the mixture of earth, sand, and a soil-solidifying agent. And it has advantages of allowing a simple formation of a foundation layer by omitting the process of transporting or penetrating precast piles as well as the pile formation process by cast-in-place.

The upper support layer 10 may have various structures, and it is preferable to have the overall larger cross-section compared to the width of the lower support layer 20, and the width of the lower part is narrow compared to the width of the upper part.

For specific example, the upper support layer 10 may be formed in a conical structure such as FIG. 2*a* or FIG. 2*b*.

With this structure, the friction surrounding the upper support layer 10 increases and it has the effect of reducing the overall depth of a foundation structure (FIG. 2).

This may be efficiently used when the ground has a relatively good bearing capacity of soil.

When the depth of the lower support layer 20 is formed largely deeper compared to the depth of the upper support layer 10, the effect stated above may be more significantly achieved.

Meanwhile, it is preferable that the upper support layer is placed on the surface layer of the ground; the lower support layer 20 is placed on the middle layer or the deep layer; thus each length of the upper support layer 10 and the lower support layer 20 is determined accordingly.

In this case, it is conveniently preferable that the upper support layer 10 and the lower support layer 20 have a cylindrical structure to form a boring hole.

According to the exemplary embodiment of the present invention stated hereinabove, the following effects may be obtained.

First, the ground is not formed to have a generally constant bearing capacity of soil, and there exist various layers (supporting layers such as a weak stratum, a rock layer, and so on) with different bearing capacities of soil depending on their depths. In concord with this, various foundation layers with different cross-sectional sizes can be disposed, and thus efficient structures may be obtained.

Second, in the deep depth, a boring hole formed with a small diameter is sufficient to form the lower support layer 20 compared to the case in the shallow depth (upper support layer), and therefore this allows to reduce the amount of material injection and prevents the overload of boring equipment.

Third, when a tapering variable cross-section support layer 11 with a variable cross-sectional structure is formed in between the upper support layer 10 and the lower support layer 20 (the lower part of the upper support layer 10), it is effective to prevent a stress concentration caused by a sharp change of the cross-section.

When the ground is formed downward in the order of a weak stratum a and a support layer b, it is preferable that the boundary part (variable cross-section support layer 11) of the upper support layer 10 and the lower support layer 20 is formed to place in either the lower part of the weak stratum a or the upper part of the support layer b; the lower support layer 20 is formed to place in the support layer b (FIG. 3).

In FIG. 3, 4, X-axis represents bearing capacity of soil.

In this case, the lower support layer 20 formed on the support layer b performs to reinforce and support bearing capacity of soil caused by the upper support layer 10, and thus it is effective to reduce the cross-section of the upper support layer 10 compared to in the absence of the lower support layer 20.

Also, when a highly intensive boring operation is performed in the deep depth support layer b, the diameter of the boring hole may be reduced, which prevents the overload of boring equipment.

Weak stratum and support layer here are relative notions that are determined by the property of the structure constructed on the ground with other conditions in the site. Generally, a support layer includes a layer of weathered soil, weathered rock, etc., and a layer with relatively weaker bearing capacity of soil is considered as a weak stratum.

When the ground is formed downward in the order of a first weak stratum a1, a first support layer b1, a second weak stratum a2, and a second support layer b2, it is preferable that the boundary part (variable cross-section support layer 11) of the upper support layer 10 and the lower support layer 20 is formed to place in either the lower part of the first weak stratum a1 or the upper part of the first support layer b1; the lower part of the lower support layer 20 is formed to place in either the lower part of the second weak stratum a2 or the upper part of the second support layer b2 (FIG. 4).

In this case, with the absence of the support layer 20, the stable bearing capacity of soil in the upper support layer 10 provided by the second weak stratum a2 may not be expected. However, in case with a method according to the present invention, wherein the lower support layer 20 is supported by the second support layer b2 passing through the second weak stratum a2, the overall excellent structural stability may be obtained.

The strength of a foundation structure according to the present invention is determined by the type of solidifying agent and the amount used, and it is generally preferable to have the bearing capacity of 0.1~10 MPa.

Further, the size of a foundation structure according to the present invention is determined by the design load, and it is generally preferable that the width of the upper side of the upper support layer 10 is 0.5~3 m; the depth of the upper support layer 10 is 0.5~10 m; the width of the lower support 20 is 0.1~1.0 m; the depth of the lower support layer 20 is 1.0~60 m.

Meanwhile, adopting a structure in which a steel or concrete material core 21 is additionally inserted is more preferable for the structural stability and constructability of the overall foundation structure (FIG. 5, 6).

In this case, the structures of steel bars, steel pipes, H piles, and PHC piles may be applied to the core 21.

In the structural stability aspect of this core 21, it is preferable to adopt the structure, wherein the top of the core is laid under the ground while penetrating into the center of the upper support layer 10 by solidified soil.

Hereunder is given a description of the method for the construction of the hybrid foundation structure according to the present invention.

Basically, in order to form the upper support layer 10 and the lower support layer 20, the boring hole 1 is formed on the ground while the mixture of earth, sand, and a soil-solidifying agent is injected into the boring hole 1.

Alternatively, in order to form the upper support layer 10 and the lower support layer 20, the following construction steps may be applied: a boring step to form a boring hole on the ground; a basic formation step to form the upper support layer 10 and the lower support layer 20 by injecting the mixture of earth, sand, and a soil-solidifying agent into the boring hole.

The above construction method may specifically be implemented by the following exemplary embodiments.

First, the upper support layer 10 and the lower support layer 20 may be simultaneously formed by (FIG. 1): forming a small boring hole 22 to form the lower support layer 20 (FIG. 7); extending the upper part of the small boring hole 22 to form a large boring hole 12 for forming the upper support layer 10 (FIG. 8); injecting the mixture of earth, sand, and a soil-solidifying agent into the small boring hole 22 and the large boring hole 12.

Second, the upper support layer 10 may be formed by (FIG. 1): forming a small boring hole 22 to form the lower support layer 20 (FIG. 7); injecting the mixture of earth, sand, and a soil-solidifying agent into the small boring hole 22 for forming the lower support layer 20 (FIG. 9); extending the upper part of the small boring hole 22 to form a large boring hole 12 for forming the upper support layer 10 (FIG. 10); injecting the mixture of earth, sand, and a soil-solidifying agent into the large boring hole 12.

Third, the upper support layers 10 may be formed by (FIG. 1): forming a plural small boring holes 22 to form the plural lower support layers 20 (FIG. 11); injecting the mixture of earth, sand, and a soil-solidifying agent into the plural small boring holes 22 for forming the plural lower support layers 20 (FIG. 12); extending the upper parts of the plural small boring holes 22 to form a large boring holes 12 for forming the plural upper support layers 10 (FIG. 13); injecting the mixture of earth, sand, and a soil-solidifying agent into the plural large boring holes 12.

Fourth, the plural upper support layers 10 and the plural lower support layers 20 may be formed by: forming a plural large boring holes 12 to form the plural upper support layers 10 (FIG. 14); excavating the lower parts of the plural large boring holes 12 to form a plural small boring holes 22 for forming the plural lower support layers 20 (FIG. 15); injecting the mixture of earth, sand, and a soil-solidifying agent into the plural large boring holes 12 and the plural small boring holes 22.

The plural large boring holes 12 may be formed and mutually spaced as shown in FIG. 14, whereas the neighboring large boring holes 12 may be formed overlap.

Since the above exemplary embodiments have their own advantages and disadvantages, preferable methods may be selected considering the conditions of the site, equipment and so on.

Meanwhile, when the lower support layer 20 is formed by the separate core 21, the following process is performed (FIG. 5, 6).

In order to form an upper support layer 10 and a lower support 20, a boring hole is formed on the ground and a core 21 is penetrated into the boring hole.

The mixture of earth, sand, and a soil-solidifying agent is injected into the boring hole to form the upper support layer 10 and the lower support layer 20.

Conversely, the mixture of earth, sand, and a soil-solidifying agent may be injected into the boring hole first, and then the core 21 may be penetrated before the hardening of the mixture.

The earth and sand to be mixed with a soil-solidifying agent are sufficiently produced in the field, and slimes produced in the boring step may be mixed together simultaneously when performing a boring step.

However, when the strength of slimes is weak, it is preferable to be mixed with aggregates (sand or pebbles) to use. In this case, a part of slimes produced in the boring step is ridged and the mixture of the remaining slimes, aggregates, and a soil-solidifying agent is injected.

Hereunder is given a description of an example of a soil-solidifying agent for the method according to the present invention.

Soil-solidifying agent is basically comprised of 22.4~35.7 parts by weight of calcium chloride; 12~28 parts by weight of ammonium chloride; 21.42~34.68 parts by weight of magnesium chloride; 1.2~7 parts by weight of magnesium sulfate; 8~13 parts by weight of sodium aluminate; 4~10 parts by weight of lignin sulfonate; 2.5~3.5 parts by weight of magnesium stearate; 1~2 parts by weight of divalent iron compound including iron sulfate.

As the first example, in case of the loam soil, the compressive strength of 20 kgf/cm$^2$ or higher with excellent freeze-thaw capability and impermeability may be obtained just by mixing 1~2 kg of the soil-solidifying agent and 70~100 kg of binder including cement into each 1 m$^3$ of the soil for solidification.

In this case, 8~11 parts by weight of sodium aluminate and 4~7 parts by weight of lignin sulfonate are sufficient to be applied.

The soil-solidifying agent here is in the form of an aqueous solution, and it is preferable to inject 30~35 l into each 1 m$^3$ of the soil for constructability and structural stability.

As for the binder, cement only may be used. However, when adopting the composition comprising: 30~40 parts by weight of cement; 50~60 parts by weight of slag or fly ash; 5~15 parts by weight of plaster, more excellent physical properties may be obtained. And these may be provided in a pre-mix form by being mixed with the soil-solidifying agent.

As the second example, in case of the soil containing a large amount of by-products of waste soils (soft clay, waste fine sediment, weathered granite soil, sludge, slime, etc.), it is preferable to mix 0.7~1.5 kg of soil-solidifying agent, 100~200 kg of binder, 20~25 parts by weights of fly ash or stone powder into each 1 m$^3$ of the soil for solidification.

Since fly ash or stone powder is an inorganic material of soil-based aggregates, it is mixed with soils to act as reinforcement. When there is a large quantity of by-products of waste soils, fly ash or stone powder mixed with soils and a solidifying agent provides a granular material having excellent compressive strength, tensile strength, abrasion resistance, load carrying capacity, and freeze-thaw capability.

Further, when 60~90 l of additional liquid sodium silicate is mixed into each 1 $m^3$ of the soil, more excellent solidification effect may be obtained.

The alkaline component ($Na_2O$) contained in the liquid sodium silicate ($Na_2O$-$nSiO_{2-x}H_2O$) activates the silica component contained in pozzolan, and forms a compound of calcium silicate using silica or anion parts.

This shortens the gel-time among soils, cement, and sodium silicate, which allows having the property of an accelerating agent.

In particular, since liquid sodium silicate (3-sec accelerated condensation), a denaturalized sodium silicate, is considered to be a strong alkaline aqueous solution with a low mole ratio (2.0~2.5), it obtains the physical property of water resistance from sodium silicate. Moreover, the liquid sodium silicate is composed of main components of soil based aggregates including $SiO_2$, $Al_2O_3$, $Fl_2O_3$, CaO, etc. requiring grade variation, and therefore it may obtain a permanent structure by the strongly bonded body of hardening.

Accordingly, since the liquid sodium silicate improves the reaction of pozzolan, it allows the effects including early strength development, hardening acceleration, excellent durability and so on.

TABLE 1

| Item | 3 levels (Type 3) |
|---|---|
| Specific Gravity (20° C.) | 1.380 or more |
| Silicon dioxide ($SiO_2$) (%) | 28~30 |
| Sodium oxide ($Na_2O$) (%) | 9~10 |
| Iron (Fe) (%) | 0.03 or less |
| Mole ratio | 2.0~2.5 |

Table 1 shows the physical property of the liquid sodium silicate (KSM1415).

As for the binder, cement only may be used. However, when adopting the structure comprising: 30~40 parts by weight of cement; 50~60 parts by weight of slag or fly ash; 5~15 parts by weight of plaster, more excellent physical properties may be obtained. And these may be provided in a pre-mix form by being mixed with the soil-solidifying agent.

As the third example, in case of the weak stratum, the compressive strength of 10~50 kgf/$cm^2$ or higher with excellent freeze-thaw capability and impermeability (permeability coefficient $1\times10^{-7}$ cm/sec) may be obtained just by mixing 1~2 kg of the soil-solidifying agent and 70~100 kg of binder including cement into each 1 $m^3$ of the soil for solidification.

In case of soft cohesive soils and cohesive sediments, polymer compounds and the like which are dispersed and generated in organic matters (Humic acid) and have a high gravimetric water content are dissolved in the adhesion water around soil particles, therefore when a solidifying agent containing cement is injected, it creates a problem of which the cement paste layer reacts with calcium ions and form an impervious film on the surface of cement hydrates.

The soil solidifying agent uses 11.1~13 parts by weight of sodium aluminate, and 7.1~10 parts by weight of lignin sulfonate. These components allow uniform distribution of soft and fragile soil particles; increase integrity of soft clay; induce stable hydration features.

In this case, the soil-solidifying agent is in the form of an aqueous solution, and it is preferable to inject 30~35 l of the mixture into each 1 $m^3$ of the soil for constructability and structural stability.

As for the binder, cement only may be used. However, when adopting the structure comprising: 30~40 parts by weight of cement; 50~60 parts by weight of slag or fly ash; 5~15 parts by weight of plaster, more excellent physical properties may be obtained. And these may be provided in a pre-mix form by being mixed with the soil-solidifying agent.

In addition to the soil solidifying agent, when 1~5 l of an aqueous solution, wherein 3~5 parts by weights of an emulsion solution mixed with a methacrylic resin and a silica-based solidifying agent, is added, a three-dimensional network structure is formed by chemical bonds between soil particles, and it allows the advantage of promoting the reaction of hardening the polymer by cross-linking.

Thus, when a foundation structure is formed by the mixture of field generated soil and a soil solidifying agent (the composition of cement and binders), following effects are expected.

First, since the mixture of a binder's composition using various materials as well as cement are applied to the soil solidifying agent, the improved effects on compactness, early strength development, and strength enhancement may be obtained.

Second, the covalent bond between cement and the components of the binder's composition allows a strong effect on promoting hardening.

Third, even if the field generated soil is defective such as soft cohesive soil, dredging waste soil, and organic matter containing soil, due to the effect of improvement in the binder's composition, a stable strength may be obtained.

Fourth, the basic ground reinforcement as well as the effects on soft ground improvement, surface layer solidification, deep layer solidification, etc., may be additionally obtained.

Fifth, the soil solidification effects including delay of water infiltration, soil bearing capacity enhancement, prevention of subsidence, etc. may be improved.

Sixth, there is no boundary surface between natural ground and solidified soil.

Seventh, due to non-liquefaction, no re-slurrification occurs after soil solidification.

Eighth, the soil solidification tailored for each purpose is available.

Ninth, due to the implement of early strength, a fast solidification effect may be expected.

Tenth, since all field generated soils may be used; non-environmental concrete structures may be replaced; construction wastes may be mixed and used with field generated soils, it is environmentally friendly.

The preferable embodiments implemented according to the present inventions hereinbefore are only partially explained, therefore the scope of the present invention should not be interpreted restricted to the embodiments above. In addition, the scope of the present invention may include all the technical idea of the present inventions and the technical ideas sharing the same foundation thereof.

A hybrid foundation structure according to another embodiment of present invention can be constructed in a simple manner by disposing a plurality of peripheral piles around a central pile.

As illustrated in FIG. 16, the hybrid foundation structure according to the present invention includes a first perforation hole 32 formed in the ground E; at least one second perforation hole 42 formed adjacent to the first perforation hole 32 on a side surface of the first perforation hole 32; and a first pile 30 and a second pile 40 formed by mixing and injecting soil and soil solidifier into the first perforation hole 32 and the second perforation hole 42. The first pile 30 and the second pile 42 are formed adjacent to each other in the ground E reinforcing the ground.

Accordingly, it is possible to provide a variable-sectioned hybrid foundation structure having various configurations and depths by forming a plurality of second piles 40 having various depths around the first pile 30.

The first perforation hole 32 and second perforation hole 42 may be formed sequentially by a single-axis auger or may be easily formed simultaneously using a multi-axis auger 100 as shown in FIG. 17.

If the multi-axis auger 100 is used, a perforation apparatus may be configured to all auger axis simultaneously form holes down to a predetermined depth and then move some auger axis downward to deeper.

The first perforation hole 32 and the second perforation hole 42 may have different diameters depending on the ground condition.

The second perforation holes 42 may be disposed symmetrically or asymmetrically around the first perforation hole 32 depending on the perforation position, the ground condition, and the like.

The second perforation hole 42 may be formed to be in contact with the first perforation hole 32 to be connected with each other or may be spaced apart from each other.

The first pile 30 and the second pile 40 can be formed by mixing the soil and the soil solidifying agent into the first perforation hole 32 and the second perforation hole 42 respectively.

The soil solidifying agent may be sprayed on the ground along with the perforation for forming the first perforation hole 32 and the second perforation hole 42. And a solid foundation is formed in the ground (E) by the mixing of the soil and the soil solidifying agent.

FIG. 16 is an example of the case where the first perforation hole 32 and the second perforation hole 42 are formed one by one. This case can be effectively applicable when the reinforcement is required only one side for example, when the perforation hole is formed adjacent to the geological boundary line or when the perforation hole forming ground is not formed uniformly.

As illustrated in FIG. 17, it is also possible to continuously construct a plurality of hybrid foundation structures in succession.

FIG. 18 is an enlarged view of a perforation shaft used for perforating the hybrid foundation structure according to the present invention, wherein stirring blades 112 and 114 are formed on the outer periphery of a perforation rod 110 symmetrically and being tilted that the soil can be vertically stirred when the perforation shaft is rotated. For example, when the perforated rod 110 rotates counterclockwise as viewed from above, the first stirring blade 112 pushes up the gravel and the second stirring blade 114 pushes the gravel down to perform up and down stirring smoothly.

The first pile 30 and the second pile 40 may have different lengths. The depth of the first pile 30 formed in the first perforation hole 32 and the depth of the second pile 40 formed in the second perforation hole 42 can be different from each other. For example, as illustrated in FIG. 16, the length of the first pile 30 can be made longer than the length of the second pile 40.

The first perforation hole 32 and the second perforation hole 42 are both perforated to a depth required to reinforce the bearing force so that the first pile 30 and the second pile 40 reinforce the bearing force together. Then the first pile 30 by the first perforation hole 32 can be further extended to the under of the second pile 40 to suppress the subsidence. In other words, the first pile 30 and the second pile 40 is widened to the depth required for reinforcement of the bearing force making the upper support layer 10, and the lower portion of the first pile 30 extended to the depth required for suppress subsidence making the lower support layer 20.

When a plurality of second piles 40 are formed, the lengths of the second piles 40 may be different from each other.

As illustrated in FIGS. 19(*a*) and 19(*b*), the second pile 40 may be formed symmetrically on both sides of the first pile 30. At least one or more second piles 40 may be disposed on both sides of the first pile 30. The present invention can increase the stability of the hybrid foundation structure by disposing the second piles 40 symmetrically and in a balanced way around the first pile 30.

For example, as illustrated in FIG. 19(*a*), the first pile 30 is formed down to extend longer than the second pile 40 so the first pile 30 suppresses the subsidence of the ground. Contrarily, as illustrated in FIG. 19(*b*), the second pile 40 formed is formed to extend further downward than the first pile 30 so the second pile 40 suppress the subsidence of the ground. In this case, since the second piles 40 located on both sides of the first pile 30 simultaneously suppress the subsidence of the subsurface, the length of the second pile 40 can be shorter than that of the embodiment illustrated in FIG. 19(*a*).

The lengths of the first pile 30 and the second pile 40 can be adjusted in consideration of the ground condition, the subsidence control target, the target bearing force, and the like. That is, in the general case, the length of the first pile located at the center is made longer to suppress the subsidence of the first pile 30, and the plurality of second piles 40 are configured to mainly reinforce the bearing force. However, in some cases, when the subsidence suppression is more important than the target bearing force, the second piles 40 located outside can be extended longer to suppress the subsidence.

As illustrated in FIG. 20, at least three or more second piles 40 may be formed radially around the first pile 30. When large bearing reinforcement area is required, the second piles 40 are radially arranged to surround the first pile 30 so as to sufficiently secure the bearing area with respect to the upper ground. In this case, the lengths of the first pile 30 and the second pile 40 can be adjusted in consideration of the ground condition, the subsidence control target, the target bearing force, etc. as in the embodiment of FIG. 19.

In the case where the second pile 40 is provided at least three in radial directions around the first pile 30, the length of the first pile 30 can be shorter than the length of the second piles 40. In this case, since the under space of the first pile 30 is surrounded by the plurality of second piles 40, an effect of clogging is generated and this effect increases the bearing force. That is, the gravel located inside the plurality of second piles 40 under the first pile 30 has an effect of increasing the cross-sectional area of the base end due to the clogging effect, so that the effect of increasing the end bearing force is generated.

As illustrated in FIG. 22, the first perforation hole 32 and the second perforation hole 42 may be formed to overlap a certain area. If the areas of the first perforation hole 32 and the second perforation hole 42 are arranged so as to overlap with each other by a certain area, the first pile 30 and the second pile 40 can be further integrated. When the multi-axis auger 100 is used, the first perforation hole 32 and the second perforation hole 42 can be formed by punching the ground with different vertical or horizontal location of the auger screw.

As illustrated in FIG. 23, an enlarged perforation hole 52 connected with the first perforation hole 32 and the second perforation hole 42 can be perforated on the first perforation hole 32 and the second perforation hole 42 to form a large pile 50 on the first pile 30 and the second pile 40. When the target bearing force is high and the importance of the subsidence suppression is high in relation with the ground condition or the load condition of the upper structure, etc., the large pile 50 having a large diameter is formed at the upper portion to reinforce the bearing force, and the first pile 30 and the second pile 40 are both formed for subsidence suppression.

The invention claimed is:

1. A hybrid foundation structure comprising:

a first pile disposed in ground;

second and third piles disposed adjacent to the first pile and disposed symmetrically with respect to the first pile, a length of the second pile being substantially equal to a length of the third pile; and a fourth pile disposed on the first, second, and third piles, the fourth pile having a hemispherical shape, wherein each of the first, second, and third piles extends from a lower surface of the fourth pile, wherein each of the first, second, third, and fourth piles includes soil and soil solidifying agent, and wherein a length of the first pile is different from each of the length of the second pile and the length of the third pile.

2. The hybrid foundation structure according to claim 1, wherein the second and third piles are disposed at opposite sides of the first pile.

3. The hybrid foundation structure according to claim 1, further comprising a fifth pile having a length equal to the length of the third pile, and wherein the second, third, and fifth piles are provided radially around the first pile.

4. The hybrid foundation structure according to claim 1, wherein the length of the first pile is shorter than each of the length of the second pile and the length of the third pile.

5. The hybrid foundation structure according to claim 1, wherein a first portion of the first pile overlaps with a portion of the second pile, and a second portion of the first pile overlaps with a portion of the third pile.

6. The hybrid foundation structure according to claim 1, wherein a top surface of the first pile, a top surface of the second pile, and a top surface of the third pile correspond to first, second, and third portions of the lower surface of the fourth pile, respectively, and wherein a bottom surface of the first pile, a bottom surface of the second pile, and a bottom surface of the third pile are coplanar with each other.

7. The hybrid foundation structure according to claim 6, wherein the length of the first pile is a distance between a center of the top surface of the first pile and a center of the bottom surface of the first pile, the length of the second pile is a distance between a center of the top surface of the second pile and a center of the bottom surface of the second pile, and the length of the third pile is a distance between a center of the top surface of the third pile and a center of the bottom surface of the third pile.

* * * * *